US011401015B2

(12) United States Patent
Grossman

(10) Patent No.: US 11,401,015 B2
(45) Date of Patent: Aug. 2, 2022

(54) PORTABLE SURVIVAL DEVICE

(71) Applicant: Peter J. Grossman, San Diego, CA (US)

(72) Inventor: Peter J. Grossman, San Diego, CA (US)

( * ) Notice: Subject to any disclaimer, the term of this patent is extended or adjusted under 35 U.S.C. 154(b) by 0 days.

(21) Appl. No.: 16/721,540

(22) Filed: Dec. 19, 2019

(65) Prior Publication Data

US 2021/0188410 A1 Jun. 24, 2021

(51) Int. Cl.

| | |
|---|---|
| ***B63C 9/13*** | (2006.01) |
| ***B63C 9/20*** | (2006.01) |
| *B63C 9/00* | (2006.01) |
| *E04H 15/20* | (2006.01) |

(52) U.S. Cl.

CPC ..... *B63C 9/13* (2013.01); *B63C 9/20* (2013.01); *B63C 2009/007* (2013.01); *E04H 15/20* (2013.01); *E04H 2015/201* (2013.01)

(58) Field of Classification Search

CPC ..... B63C 2009/007; B63C 9/19; B63C 9/20; A01M 31/025; E04H 15/20; E04H 2015/201

See application file for complete search history.

(56) References Cited

U.S. PATENT DOCUMENTS

| | | | | |
|---|---|---|---|---|
| 2,646,019 | A | 7/1953 | Chetlan | |
| 3,217,325 | A | 11/1965 | Mullin | |
| 3,540,170 | A | 11/1970 | Flowers | |
| 4,044,711 | A | 8/1977 | Jamison | |
| 4,114,561 | A | 9/1978 | Asaro | |
| 4,586,456 | A | 5/1986 | Forward | |
| 4,768,739 | A | 9/1988 | Schnee | |
| 5,860,251 | A | 1/1999 | Gleich | |
| 6,173,671 | B1 | 1/2001 | Casull | |
| 6,270,386 | B1 | 8/2001 | Visocekas | |
| 7,008,281 | B2 * | 3/2006 | Ketko | A47C 15/006 297/250.1 |
| 7,134,926 | B2 | 11/2006 | Moeller | |
| 7,337,750 | B2 | 3/2008 | Drake | |
| 9,192,152 | B1 | 11/2015 | Sparks | |
| 9,227,706 | B2 | 1/2016 | Darroch | |
| 9,901,074 | B2 | 2/2018 | Mott | |
| 9,974,298 | B2 | 5/2018 | Arnold | |
| 10,278,379 | B2 | 5/2019 | Holt | |
| 2004/0157514 | A1 | 8/2004 | Courtney | |
| 2005/0028720 | A1 | 2/2005 | Bell | |
| 2005/0098088 | A1 | 5/2005 | Mazza | |
| 2012/0090248 | A1 | 4/2012 | Thompson | |
| 2012/0214371 | A1 * | 8/2012 | Pisor | B63C 11/26 441/30 |
| 2012/0300435 | A1 * | 11/2012 | Hill | B63C 9/20 362/103 |

(Continued)

FOREIGN PATENT DOCUMENTS

| | | | |
|---|---|---|---|
| WO | 2000015494 | A1 | 3/2000 |
| WO | 2012008855 | A1 | 1/2012 |

*Primary Examiner* — Andrew Polay

(74) *Attorney, Agent, or Firm* — Buche & Associates, P.C.; John K. Buche; Bryce A. Johnson

(57) ABSTRACT

Summary, the system is a 3D pop-up or pop-out survival system. The system sometimes involves a device that is worn on a person. The device potentially includes an activation button that, when pressed, releases an inflatable or memory spring pop-up/pop-out.

10 Claims, 9 Drawing Sheets

(56) References Cited

U.S. PATENT DOCUMENTS

| | | | | |
|---|---|---|---|---|
| 2013/0318886 | A1 | 12/2013 | Hester | |
| 2016/0015094 | A1* | 1/2016 | Walker | A62B 33/00 441/80 |
| 2021/0086878 | A1* | 3/2021 | Darroch | B63C 9/155 |

* cited by examiner

PORTABLE SURVIVAL DEVICE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

Field of Invention

The present invention relates generally to the field of outdoor survival equipment and predator deterrents.

Background of the Invention

Whether it be to escape the monotony that is a day job or simply as a hobby, millions of people year-round find themselves in the wilderness to hike, camp, fish, or to enjoy a variety of other activities—the national park service alone reported over 318 million visits in 2018.

While the majority of nature-lovers elect to take part in the outdoor lifestyle, inevitably some will not do so by choice, finding themselves and their parties unintentionally lost in nature. Some of these people may have survival training, and some will not.

Regardless of the given person's intent in exploring, the tools and skills required to survive in nature differ greatly from those employed in more urban environments. Most people are not accustomed to surviving on their own, and as such lack many of these tools and skills. Furthermore, even the most experienced survivors will recognize the utility of having a good, functional survival tool.

Thus, a need exists for a device that will aid people generally in surviving or more safely enjoying recreational activities nature be it at land or at sea.

SUMMARY OF THE INVENTION

Accordingly, it is an object of the present invention to provide a device that will allow wearers or users to better protect themselves in the wilderness.

Another object of the present invention is to provide recreational hunters and explorers, both military and civilian, with a portable and wearable means to easily camouflage themselves amongst their surroundings.

What is disclosed may be a 3D pop-up or pop-out survival system. The system involves a device that is worn on a person. The device includes an activation button that, when pressed, releases an inflatable or memory spring pop-up/pop-out. The pop-up/pop-outs can have patterns that are noticeable, camouflage, or wildlife deterrent. The pop-up/pop-out can be any shape, but circular, square, and pyramid shapes are preferred. In some cases, memory spring pop-ups/pop-outs are folded small and placed within the device. For inflatable pop-ups, the device includes, e.g., a CO2 cartridge, compressed water, foam, and the like. Some popups could include loud noise makers or bright lights. In a preferred embodiment, the pop-up/pop-out has load-bearing edges defined by inflated tubes.

The device may be worn on the user's person and usually comprises a main housing unit from which the user may access various functionalities such as an audiovisual predator deterrent system and a distress-signaling system. Different functionalities may be included in different embodiments.

The device may also include an inflatable member which can be deployed at variable speeds according to the user's preference. Such an embodiment may have a housing unit which contains different shapes and ornamental designs of inflatable members depending on the intended use. While the inflatable member can take on various shapes, circular, square, and pyramidal shapes are preferred.

The inflatable member may also be covered or coated in material with various qualities, such as being fire-retardant or hydrophobic.

Generally, the user may alter the configuration of the device as to best suit their specific needs depending on the type out outing sought—it may be most suitable to include a duck-blind configuration for a hunting trip or a larger inflatable member for trips at sea. For the purposes of this application, "wearer" and "user" are equivalent terms and should be interpreted as such.

BRIEF DESCRIPTION OF THE FIGURES

Other objectives of the invention will become apparent to those skilled in the art once the invention has been shown and described. The manner in which these objectives and other desirable characteristics can be obtained is explained in the following description and attached figures.

In the figures and the remainder of this application, the following reference numbers represent the associated components of the disclosed device:

Main housing unit—1000;
Inflatable member—1100;
Cover material—1110;
Loops—1120;
Stem—1130;
Tubes—1140;
Inflation means—1200;
Engagement node—1300;
Light source—1400;
Audio source—1500;
Power source—1600;
Internal power source—1610;
External power source—1620;
Person—2000;
Body of water—3000; and
Vessel—3100.

Figure 1:
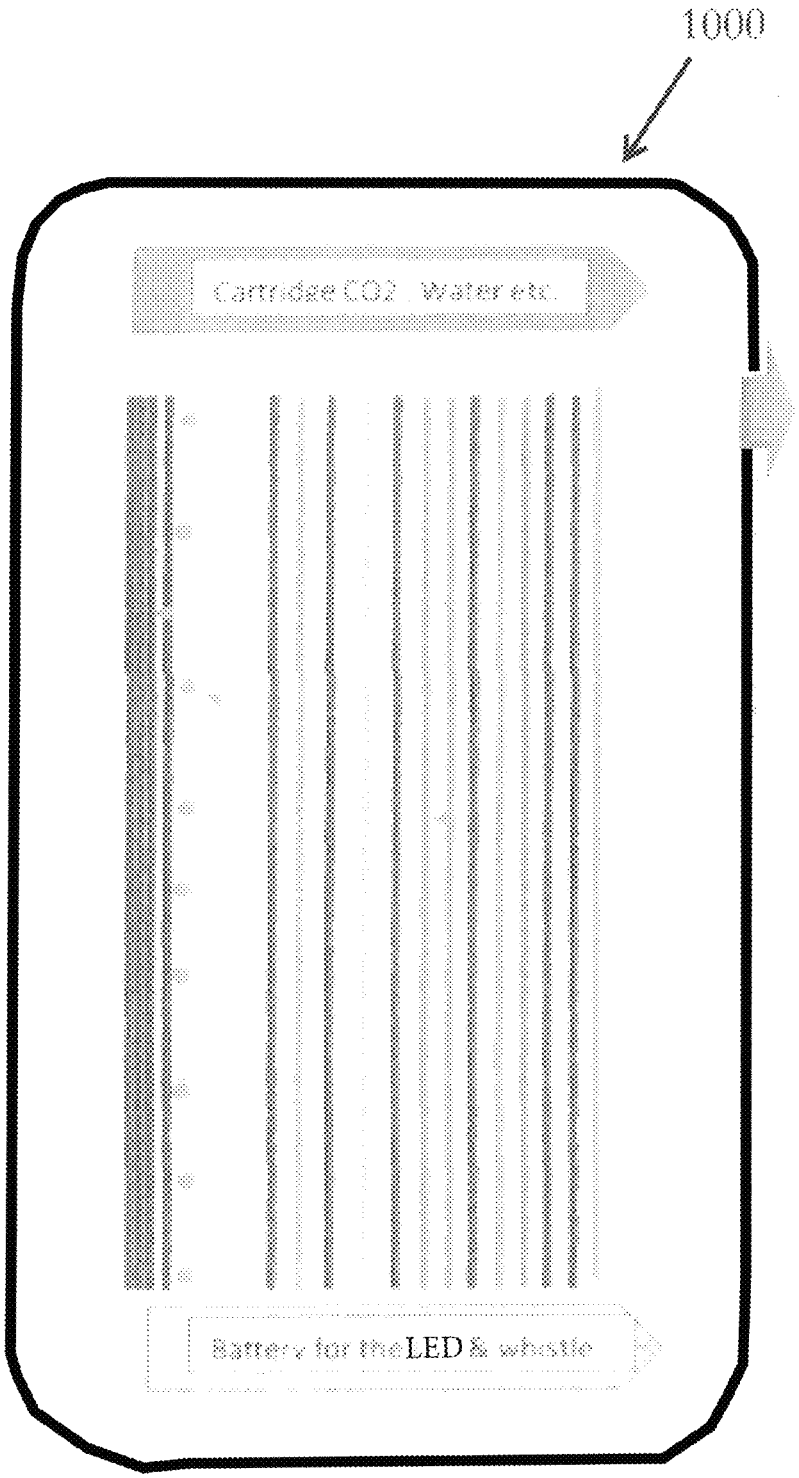

FIG. 1 is a front view of the main housing unit 1000.

Figure 2:
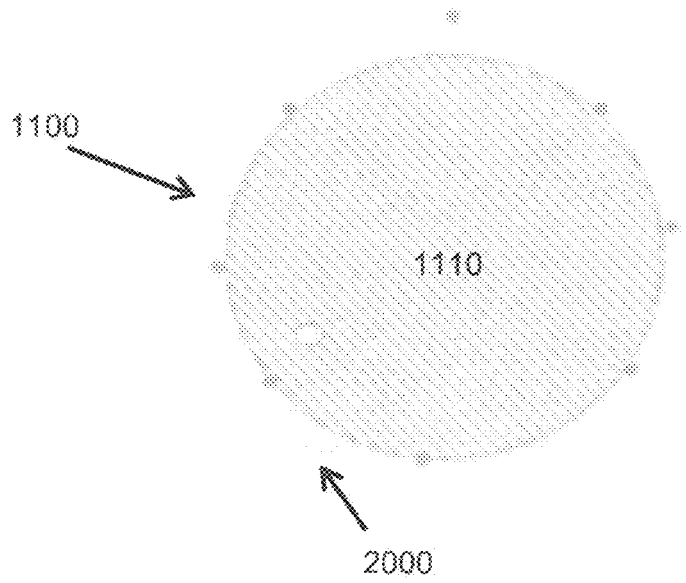

FIG. 2 shows a possible embodiment of the inflatable member 1100 fully inflated with a custom shape and cover material 1110 applied to camouflage a person 2000.

Figure 3:
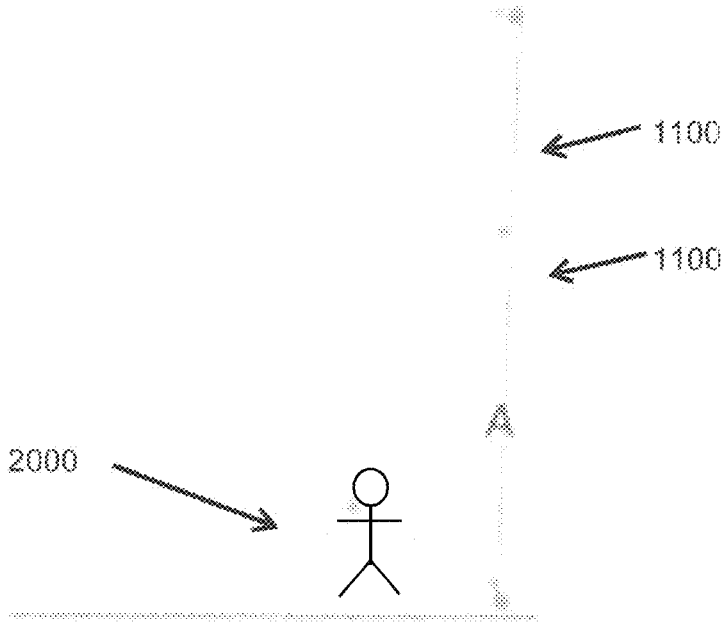

FIG. 3 is a side view of the inflatable member 1100 of FIG. 2, showing the inflatable member 1100 and the accompanying cover material 1110 next to a person 2000.

Figure 4:
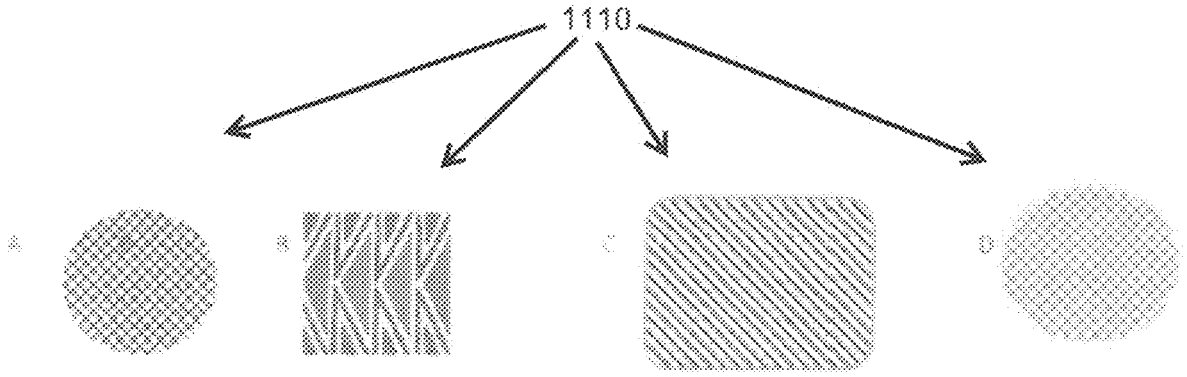

FIG. 4 illustrates some, but not all, possible shapes and ornamental designs applicable to the cover material 1110.

Figure 5:
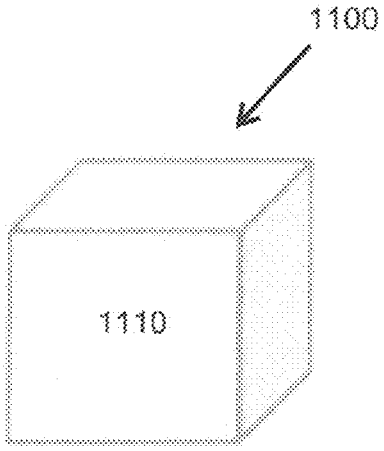

FIG. 5 shows another possible embodiment of the inflatable member 1100 and cover material 1110, taking on a cubic shape which would allow for flotation or even cover for a person.

Figure 6:
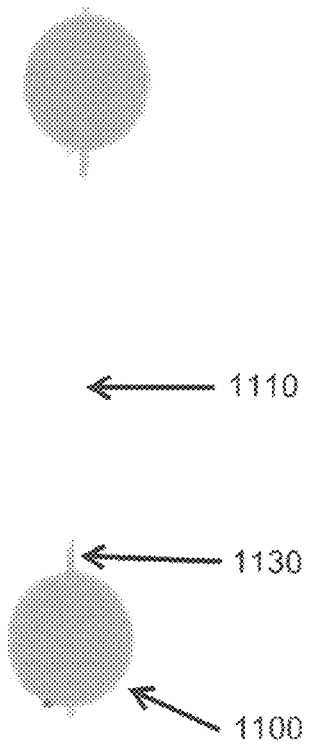

FIG. 6 is a side view of one possible embodiment, showing how the inflatable member 1100 attaches to the cover material 1110 via the use of a plurality of stems 1130.

Figure 7:
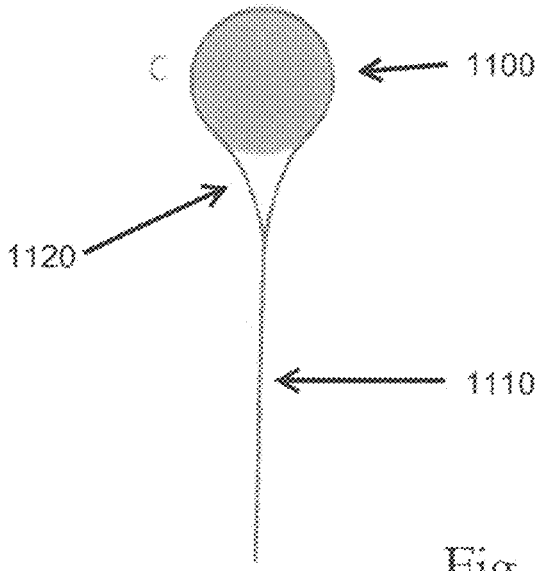

FIG. 7 is a zoomed side view of the inflatable member of FIG. 6, wherein the cover material 1110 is attached to the inflatable member 1100 via the use of loops 1120 instead of stems.

Figure 8:
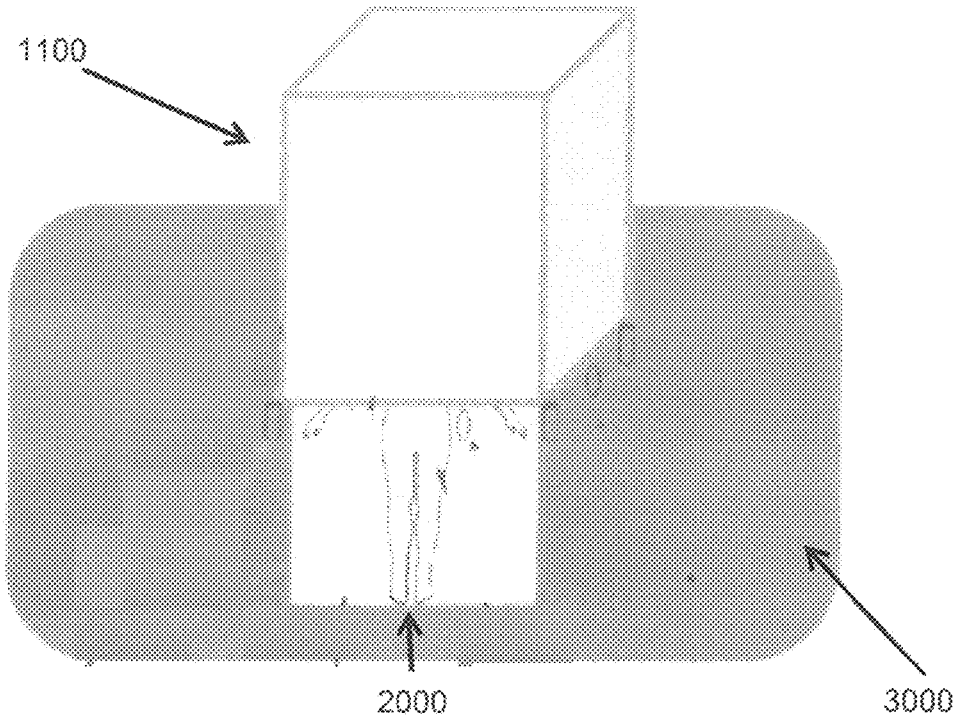

FIG. 8 is a perspective view of another embodiment of the inflatable means 1100 in which it takes on a hollow, cubic shape, enabling a person 2000 to remain covered completely. This embodiment, among others, may be covered with a fire retardant material or may be used as a flotation device to aid a person 2000 in surviving in a body of water 3000.

Figure 9:
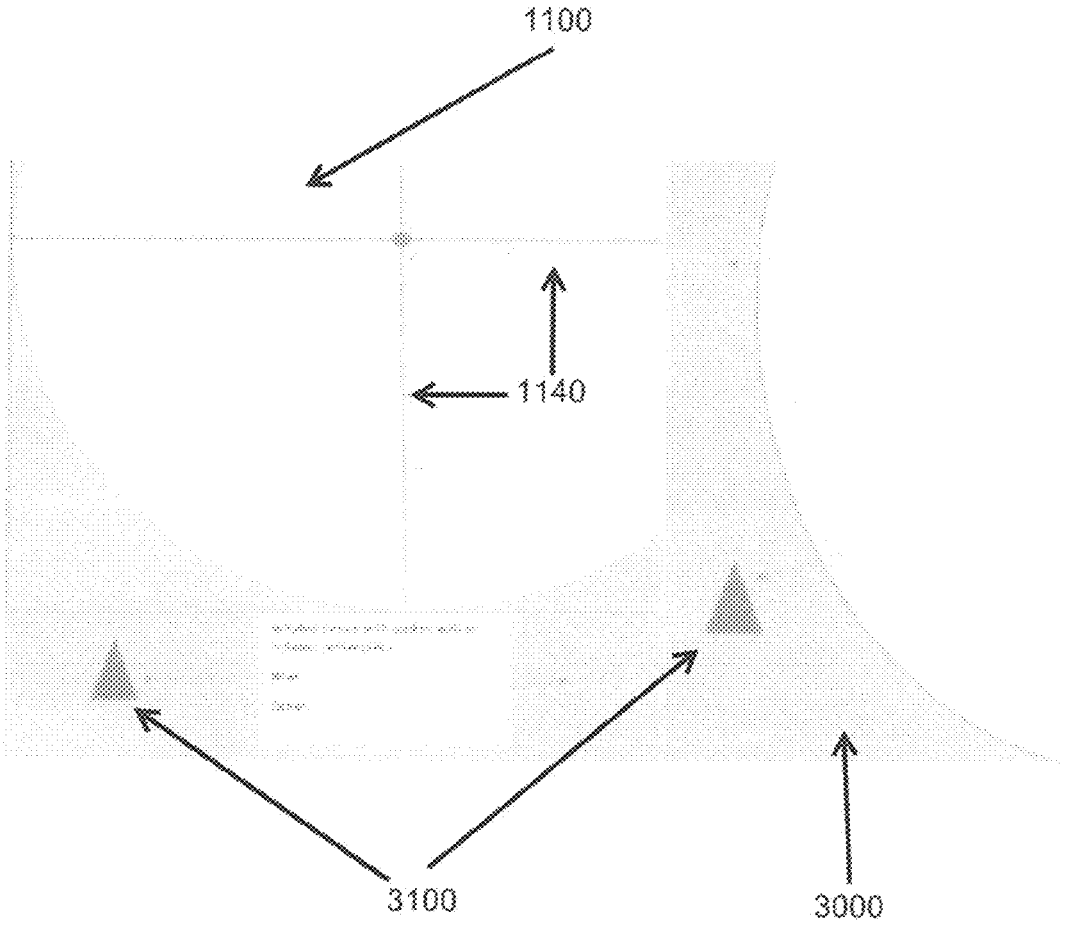

FIG. 9 shows a top view of another embodiment of the device, suitable for at-sea flotation and signaling of passing vessels. FIG. 9 shows an inflatable member 1100 of a large diameter, supported by tubes 1140 as it signals passing ships, helicopters, or any other vessel 3100 in a large body of water 3000.

Figure 10:
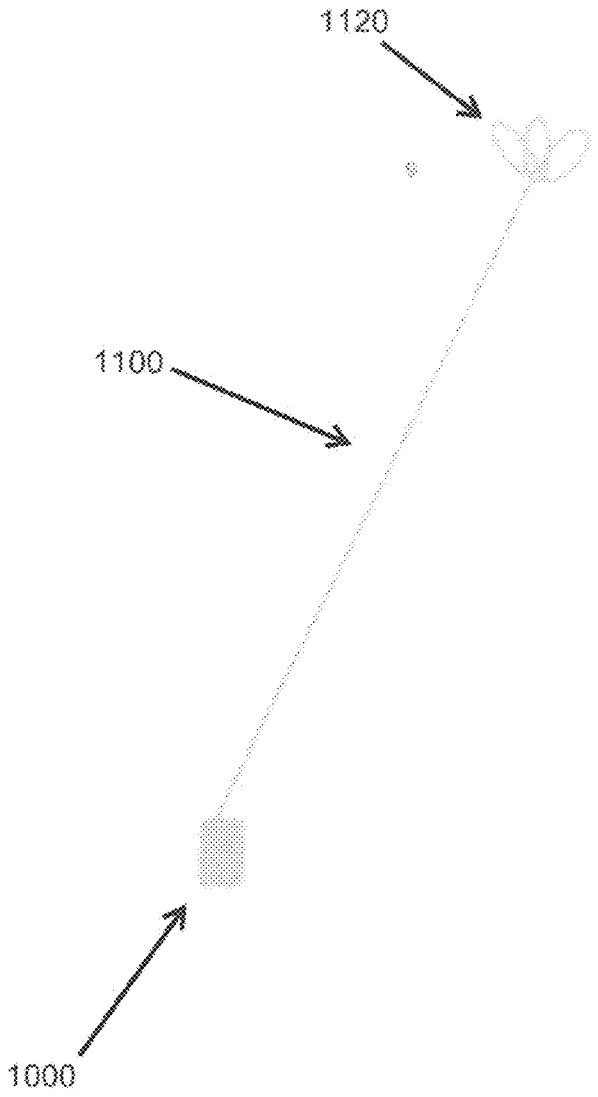

FIG. 10 shows an environmental view of one embodiment of the inflatable member 1100 in which it utilizes a series of loops 1120 to secure the inflatable member 1100 and thus the main housing unit 1000 to a tie-off or other structure so as to allow the wearer (and anchored party if secured to another person) not to be swept away when wading in moving currents.

Figure 11:
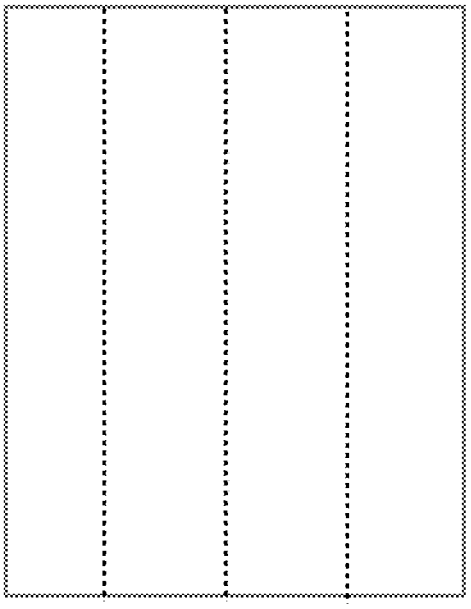

FIG. 11 shows a front view of the tubes 1140 configured in a rectangular shape with the dotted lines representing dividing lines between sections. The inflatable member may be divided into smaller components as illustrated here, and may be made from Millar or any other plastic, among other things, that may be welded or glued so as to enable it to hold air, water, or another fluid.

Figure 12:
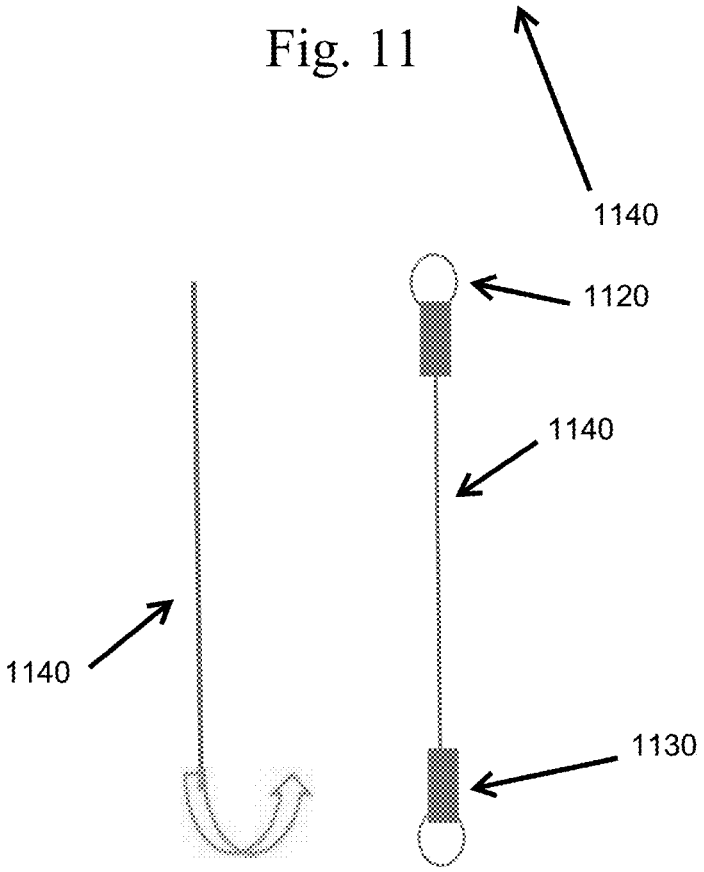

FIG. 12 shows a side view of the tubes 1140 of the inflatable member 1100 and how they may be configured to form a loop. This may be accomplished, among other methods, by heat or sonic welding. The figure additionally shows the loops 1120 as attached to the stem 1130.

Figure 13:
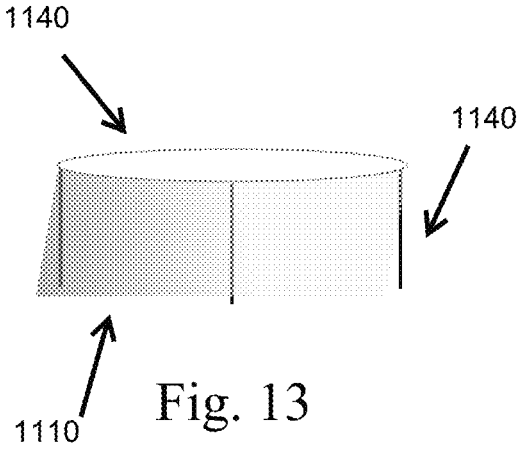

FIG. 13 shows a front view of a possible configuration of the device in which the cover material 1110, hung from the tubes 1140, is used to collect moisture and dew from the surrounding environment.

Figure 14:
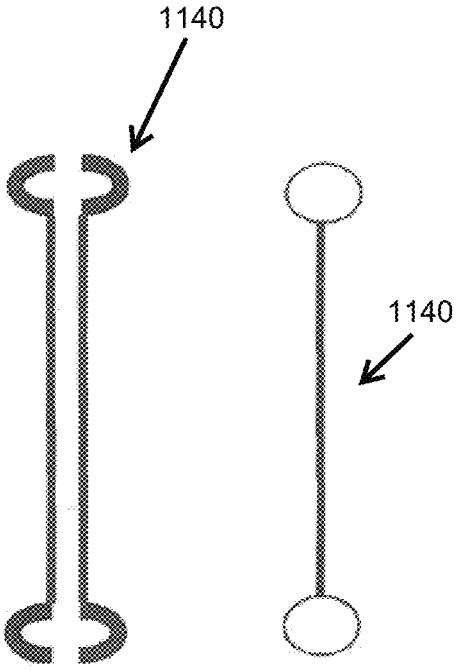

FIG. 14 shows an expanded view of how the tubes 1140 and stems 1130 may separate and reconnect. The figure additionally shows a fully connected configuration.

Figure 15:
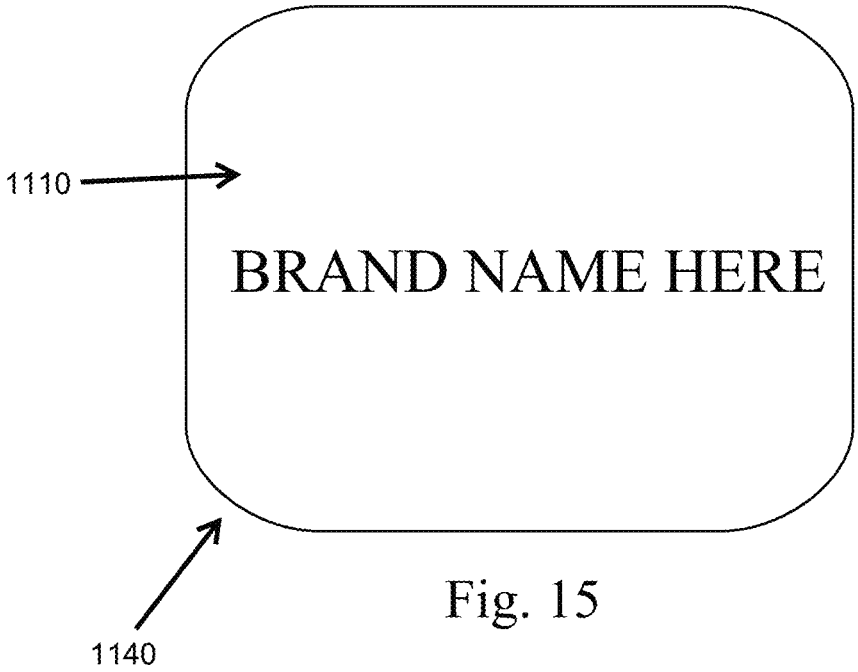

FIG. 15 shows a front view of the tubes 1140 and the cover material 1110 used to display a custom message—a company's mark or representation of a good or service.

It is to be noted, however, that the appended figures illustrate only typical embodiments of this invention and are therefore not to be considered limiting of its scope, for the invention may admit to other equally effective embodiments that will be appreciated by those reasonably skilled in the relevant arts. Also, figures are not necessarily made to scale but are representative.

DETAILED DESCRIPTION OF PREFERRED EMBODIMENTS

Other assembly methods may be practiced depending on the use of alternative embodiments described herein, and will be readily apparent to those skilled in the art.

Disclosed is a device purposed to, among other things, aid in personal survival. The device may also be used for recreational purposes such as providing camouflage for nature-goers as well.

As such, a typical embodiment will allow the user or wearer to control the various functionalities of the device via the use of a centralized control system, i.e., the main housing unit 1000, which will contain the various elements chosen by the user which make up the features of the chosen configuration.

The main housing unit is capable of being affixed to the wearer via a fastening means. In the preferred embodiment, the fastening means to be used is a seat-belt-like strap or sash, but other means may be used as well at the discretion of the user. Additionally, other fastening means may be substituted as to allow the wearer to affix the device to various objects. For example, a hook or rope may be used to fix the device to a sea-going vessel.

FIG. 1 illustrates one possible embodiment for the main housing unit 1000 in which it is comprised of a multitude of components having various functionalities. In the embodiment shown in FIG. 1, the main housing unit 1000 is shown to comprise an engagement node 1300. The user or wearer may engage the node 1300, a simple push-button in this figure, engaging an inflation means 1200, a $CO_2$ cartridge in this embodiment, and subsequently engaging an inflatable member 1100. The engagement node 1300 may take various forms depending on user preference such as a button, lever, or others.

The type of inflation means 1200 may also be varied. In this way, users may choose an inflation means which inflates rapidly or via the use of gasses holding characteristics different from carbon dioxide. Some embodiments may not utilize compressed gas as an inflation means whatsoever, but instead may rely on other means such as spring systems.

FIG. 1 likewise illustrates an embodiment further comprising a light source 1400, in this instance consisting of a plurality of light emitting diodes (LEDs) powered by a power source 1600 which may be either internal 1610, such as a plurality of batteries contained within the main housing unit 1000, or external 1620, such as an externally-fitted solar cell or alike device. The light source may be of varying intensity and color at the user's discretion. Additionally, some embodiments may include a light source which allows the user to cycle through various flashing patterns for purposes of, among other things, scaring predators or signaling SOS.

Some embodiments may utilize an audio source 1500 in addition to or instead of a light source 1400 for predator deterrent purposes. The audio source 1500 may produce a multitude of sound selected by the user such as a high whistle, a horn, or other sound.

The general shape of the inflatable member 1100 may be altered to suit the needs of the user. FIG. 2 depicts one embodiment in which a circular inflatable member 1100 is used, covered with a patterned cover material 1110. The pattern on the cover material may be changed so as to meet the user's needs—some uses such as hunting would likely require a concealing pattern whereas a more conspicuous design may be preferable for vessel signaling purposes.

FIG. 3, a side view of the inflatable member 1100 of FIG. 2, illustrating how a user may position themselves behind the member in order to be fully concealed. In some embodiments, the physical size of the inflatable member 1100 may be significantly larger or smaller so as to suit the needs of the user.

As shown in FIG. 4, the preferred embodiment does not have an accompanying preferable cover material 1110 design patterns, but rather allows for complete customization at will by the user. FIG. 4 illustrates various possible embodiments of the cover material 1110.

FIG. 5 illustrates such an instance in which the user has selected an embodiment of inflatable member 1100 in which said member is configured to resemble a cubic shape rather than a more two-dimensional shape. Embodiments featuring a cubic inflatable member 1100 may permit the user to enter said member to seek shelter from the elements—the member in such cases may function as an impromptu shelter. The cover material 1110 in such embodiments may be thoroughly or partially coated with hydrophobic or flame retardant solution, or may be made from such a hydrophobic or fire retardant material itself.

FIGS. 6 and 7 illustrate two possible forms in which the cover material 1110 may be fixed to the inflatable member 1100. FIG. 6 illustrates an embodiment in which the inflatable member 1100 comprises a plurality of stems 1130, wherein the stems 1130 are further configured to connect to the cover material 1110 via connecting means such as a hook and loop or a clamp.

Different embodiments may utilize different connecting means so as to allow the user full customization.

FIG. 7 depicts an embodiment in which no stems are used, but rather cover material 1110 attaches to a portion of the inflatable member 1100 via a plurality of loops 1120 so that the cover material 1110 is securely attached.

FIG. 8 shows a perspective view of one embodiment of the inflatable member 1100 in which said member take a hollow, cubic shape, allowing the wearer to contain him or herself at least partially within the device while wading in a body of water 3000. This embodiment provides the wearer with another possible mode of concealment and protection. The cover material 1110 may be coated with or otherwise introduced to, among other things, fire retardant compounds or materials so as to protect the wearer from burns. Generally, this embodiment will utilize a non-flammable gas, such as $CO_2$, as an inflation means 1200 so as to minimize the possibility of the device igniting.

In summary, the system is a 3D pop-up or pop-out survival system. The system sometimes involves a device, like the box shown in FIG. 1, that is worn on a person. The device potentially includes an activation button that, when pressed, releases an inflatable or memory spring pop-up/pop-out. This action is suitably shown in FIGS. 2 and 3. The pop-up/pop-outs can have patterns, like those shown in FIG. 4, that are noticeable, camouflage, or wildlife deterrent. The pop-up/pop-out can be any shape, but circular, square, and pyramid shapes are preferred. See, e.g., FIG. 5.

Practically, Memory spring pop-ups/pop-outs may be folded small and placed within the box (FIG. 1). For inflatable pop-ups, the box includes, e.g., a CO2 cartridge, compressed water, foam, and the like. Some popups could include loud noise makers or bright lights. In a preferred embodiment, the device has load-bearing edges defined by inflated tubes as is shown in FIGS. 2, 3, and 5. The inflated tubes are more specifically illustrated in FIGS. 6 and 7.

Suitably, your system a can be used to: (1) thwart dangerous wildlife attacks on the user by popping-up to making the user appear larger than the attacking wildlife; (2) conceal the user by pop-out camouflage; (3) shield a user from a dangerous fire via pop-out coverage (see, e.g., FIG. 8); (4) signal a user's location to rescuers via a noticeable pop-out that could double as a floatation device (see, e.g., FIG. 9); and (5) reduce the risk of drowning in a rushing river or under broken ice via a pop-out "horizontally firm" tube that can used to pull the user out of danger (see, e.g., FIG. 10).

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "assembly" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration.

All original claims submitted with this specification are incorporated by reference in their entirety as if fully set forth herein.

I claim:

1. A wearable device for concealing a waterborne user comprising:

A main housing unit;

A fastening means;

Wherein the fastening means permits the user to wear the device around the waist or to fix it to some other item;

An inflatable member;

Wherein the inflatable member, when not engaged, is wholly contained within the main housing unit;

Wherein the inflatable member, when engaged, is defined by a hollow cubic shape with five sidewalls that are all defined by a cover material that is coated with a fire retardant material;

Wherein the inflatable member, when engaged, defines a floatation device that is configured to surround and conceal any part of the waterborne user that is above water while the floatation device is floating on a water surface;

An inflation means; and

An engagement node.

2. The device of claim 1, wherein the inflation means is engaged via the user interacting with the engagement node.

3. The engagement node of claim 2, wherein said node is a push-button mechanically or electronically connected to the inflation means.

4. The device and engagement node of claim 3 further comprising a power source, wherein said engagement node is electronically or mechanically connected to the power source.

5. The inflation means of claim 4, wherein said means comprises at least one compressed gas canister or container.

6. The device of claim 5, further comprising a light source.

7. The light source of claim 6, wherein said light source is turned on or off via the user interacting with the engagement node.

8. The device of claim 7, further comprising an audio source.

9. The audio source of claim 8, wherein said audio source is turned on or off via the user interacting with the engagement node.

10. The inflatable member of claim 9, wherein said inflatable member further comprises wherein at least one of the sidewalls is defined by a customizable cover material.

* * * * *